US007402784B2

(12) United States Patent
Sim et al.

(10) Patent No.: US 7,402,784 B2
(45) **Date of Patent: *Jul. 22, 2008**

(54) MICROWAVE OVEN WITH MULTI-STAGE CHOKE SEAL

(75) Inventors: Sung-Hun Sim, Gyeonggi-Do (KR); Eung-Su Kim, Seoul (KR); Jin-Yul Hu, Seoul (KR)

(73) Assignee: LG Electronics Inc., Seoul (KR)

( * ) Notice: Subject to any disclaimer, the term of this patent is extended or adjusted under 35 U.S.C. 154(b) by 232 days.

This patent is subject to a terminal disclaimer.

(21) Appl. No.: 11/331,098

(22) Filed: Jan. 13, 2006

(65) Prior Publication Data

US 2007/0012691 A1 Jan. 18, 2007

(30) Foreign Application Priority Data

Jul. 13, 2005 (KR) ..... 10-2005-0063402

(51) Int. Cl.
*H05B 6/76* (2006.01)

(52) U.S. Cl. ..... 219/742; 219/741; 174/377; 174/387

(58) Field of Classification Search ..... 219/739–744; 174/377–387

See application file for complete search history.

(56) References Cited

U.S. PATENT DOCUMENTS

| | | | | |
|---|---|---|---|---|
| 4,313,044 | A * | 1/1982 | Staats | 219/742 |
| 6,538,241 | B1 | 3/2003 | Filipsson | |
| 2003/0141298 | A1 * | 7/2003 | Lee et al. | 219/741 |

* cited by examiner

*Primary Examiner*—Philip H Leung
(74) *Attorney, Agent, or Firm*—Birch, Stewart, Kolasch & Birch, LLP

(57) ABSTRACT

A microwave cooker comprises a body having a cooking chamber therein, the cooking chamber having one opened side, a microwave source disposed at the body for supplying microwave to the cooking chamber, a door coupled to the body for opening and closing the cooking chamber, and a multi-stage choke seal formed at the door, having different resonant frequencies at a frequency region higher than a central frequency of microwave, and having different LC resonant circuits for preventing the microwave from being leaked between the body and the door.

17 Claims, 6 Drawing Sheets

MICROWAVE OVEN WITH MULTI-STAGE CHOKE SEAL

BACKGROUND OF THE INVENTION

1. Field of the Invention

The present invention relates to a microwave cooker, and more particularly, to a microwave cooker capable of effectively preventing microwave from being leaked by enhancing a microwave damping function.

2. Description of the Background Art

A microwave cooker such as a microwave oven, an electric oven, etc. serves to heat and cook food by scanning microwave generated from a magnetron to the food.

The microwave cooker generally comprises a body having a cooking chamber, and a door coupled to the body for opening and closing the cooking chamber. A gap is formed between the body and the door.

When microwave is leaked through the gap between the body and the door, the microwave does harm to a user's body. Therefore, preventing the microwave from being leaked from the cooking chamber is required.

Various methods for preventing the microwave from being leaked from the cooking chamber through the gap between the body and the door have been proposed, in which a capacitive seal, a choke seal, or a ferrite rubber is installed between the body and the door.

The conventional method will be explained in more detail with reference to FIG. 1.

FIG. 1 is a graph showing a microwave damping curve of a microwave cooker in accordance with the conventional art, in which 'A' expressed as decibel (dB) denotes a damping degree according to a frequency (f) when the cooking chamber is closed.

In the conventional microwave cooker, a choke seal is formed at the door as a closed curve that surrounds a circumference of an opening of the cooking chamber of the body, and has a depth corresponding to ¼ of a wavelength in order to serve as a shielding portion of microwave. When the cooking chamber of the body is closed by the door, a resonant frequency (f-1) of the choke seal has the same frequency as a central frequency (f-MGT: magnetron) of microwave.

When the cooking chamber is opened, a microwave source for supplying microwave is turned off.

However, in the conventional microwave cooker, microwave is drastically leaked when the door is initially opened.

That is, before the microwave source is completely turned off, the door is opened for a certain period. As the gap between the body and the door is increased when the cooking chamber is initially opened, a microwave characteristic is changed. Accordingly, as shown in FIG. 1, the microwave damping curve is moved to the left side, and thus a damping is performed at a region having an inferior damping function. Therefore, microwave is much leaked through the gap between the body and the door.

The U.S. Pat. No. 6,538,241 (hereinafter, will be referred to as the conventional microwave cooker) discloses a microwave sealing unit for stably performing a damping at a wide frequency region.

The microwave sealing unit has a double resonant structure having two sealing cavities, and a resonant frequency of each cavity is positioned at both sides of a central frequency of microwave. As each resonant frequency has a constant gap therebetween, a gap variation of the door is not greatly influential thereon and thus a damping function can be stably performed at a wide frequency region.

However, in the conventional microwave cooker, as each resonant frequency of the microwave sealing unit is spaced from each other in order to obtain a wide bandwidth, a damping function is lowered at a region between each resonant frequency. Furthermore, since a central frequency of microwave is positioned at a region having an inferior damping function, an optimum damping function of the microwave cooker is not implemented.

The wider a gap between each resonant frequency is (that is, the wider a bandwidth is), the lower a damping function between each resonant frequency is. Therefore, when the gap between the body and the door is more than approximately 4 mm, it is difficult to prevent a leakage of microwave.

In the conventional microwave cooker, odor, smoke, etc. generated from food inside the cooking chamber contaminate an inner surface of the door, especially, the choke seal or the microwave sealing unit, and the contaminated portion is not easily washed.

BRIEF DESCRIPTION OF THE INVENTION

Therefore, an object of the present invention is to provide a microwave cooker capable of enhancing a microwave leakage blocking function and being easily cleaned.

To achieve these and other advantages and in accordance with the purpose of the present invention, as embodied and broadly described herein, there is provided a microwave cooker, comprising: a body having a cooking chamber therein, the cooking chamber having one opened side; a microwave source disposed at the body for supplying microwave to the cooking chamber; a door coupled to the body for opening and closing the cooking chamber; and a multi-stage choke seal formed at the door, having different resonant frequencies at a frequency region higher than a central frequency of microwave, and having different LC resonant circuits for preventing the microwave from being leaked between the body and the door.

The multi-stage choke seal comprises a first choke seal and a second choke seal spaced from each other with a certain gap (W) and cascaded to be in parallel with each other.

One choke seal of the multi-stage choke seal has an LC resonant circuit comprising an inductance (L) and a capacitance (C) connected to the inductance in series. Another choke seal of the multi-stage choke seal has an LC resonant circuit comprising an inductance (L) and a capacitance (C) connected to the inductance in parallel.

The multi-stage choke seal comprises a groove formed at a circumferential portion of the door and having a first cavity and a second cavity spaced from each other with a certain gap (W) by a partition wall each having an opening towards a front surface of the body; a control plate extending from one of the partition wall and a side wall of the groove for partially covering one of the two openings; and slots formed at the control plate in a circumferential direction of the door with a certain period.

The slot is extending from the side wall of the groove, and a slit connected to the slot is formed at the side wall of the groove.

The gap (W) between the choke seals is 1/15 to ⅛ of a wavelength (λ) of microwave.

A difference between each resonant frequency of the multi-stage choke seal is within 400 MHz.

A difference between a resonant frequency of the multi-stage choke seal adjacent to a central frequency of microwave and the central frequency of the microwave is within 250 MHz.

When the door is initially opened, one of each resonant frequency of the multi-stage choke seal is approximately the central frequency of the microwave.

Preferably, a transparent window having a size corresponding to a size of a front surface of the body for viewing inside of the cooking chamber is coupled to the door so as to be disposed between the door and the body.

The control plate is formed along a surface direction of the door so as to come in contact with the transparent window.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a microwave cooker according to the present invention will be explained in more detail with reference to the attached drawings.

Figure 1:
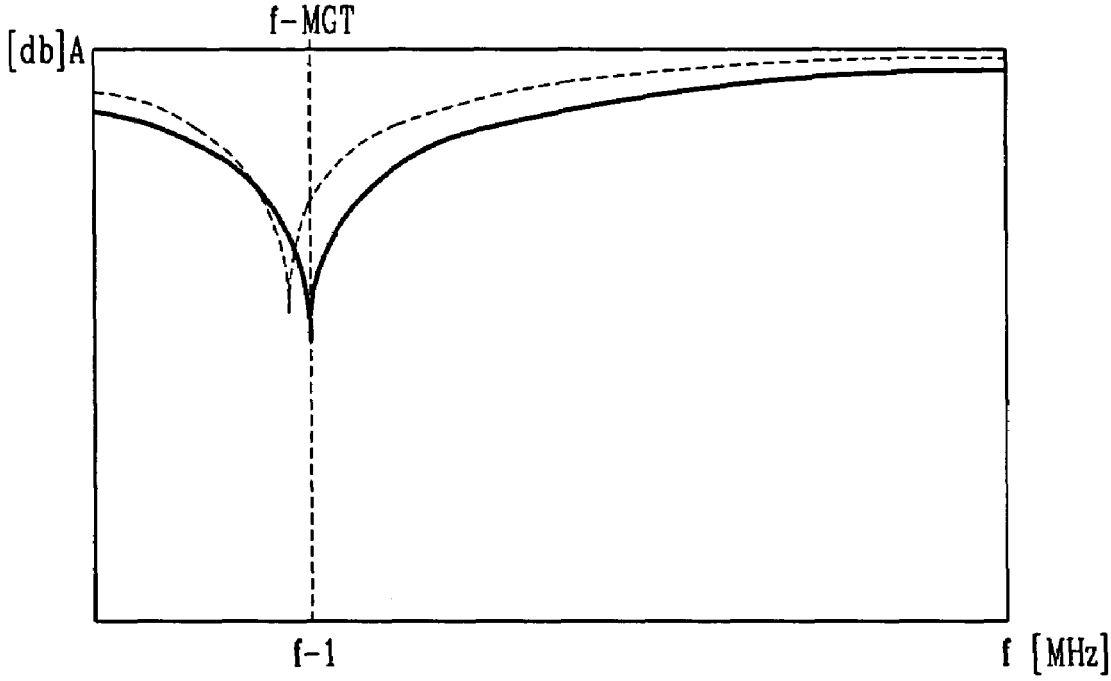
FIG. 1 CONVENTIONAL ART
FIG. 1 is a graph showing a microwave damping curve of a microwave cooker in accordance with the conventional art.
Figure 2:
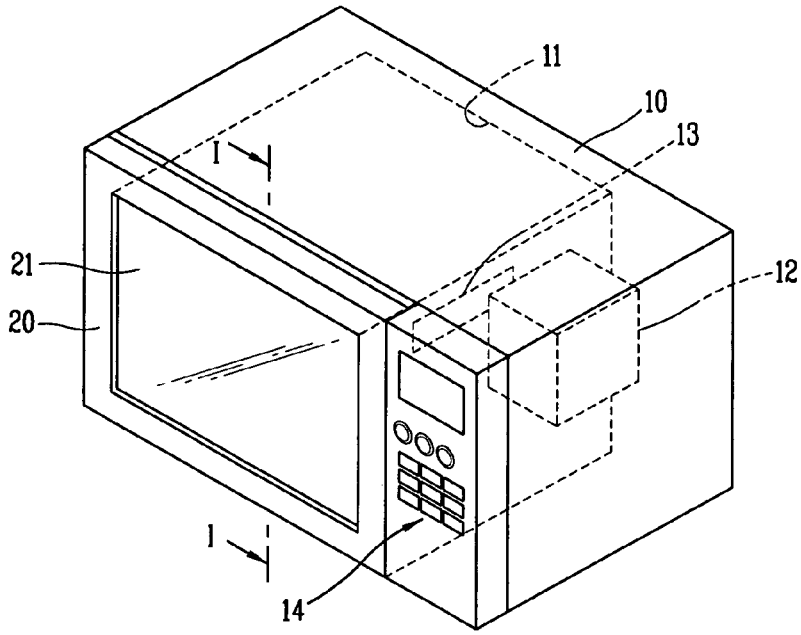
FIG. 2 is a perspective view showing a structure of a microwave cooker according to the present invention.
Figure 3:
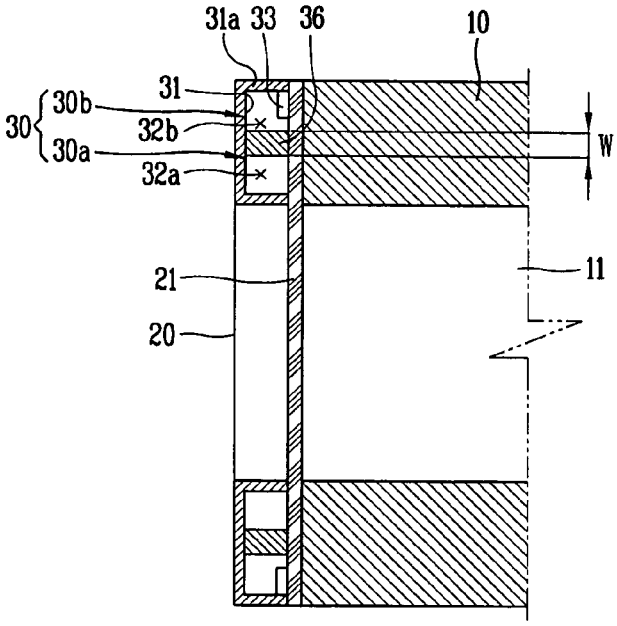
FIG. 3 is a sectional view taken along line I-I of FIG. 2.
Figure 4:
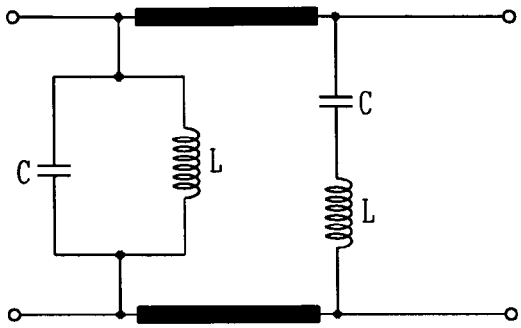
FIG. 4 is an LC resonant circuit diagram applied to a multi-stage choke seal in the microwave cooker according to the present invention.
Figure 5:
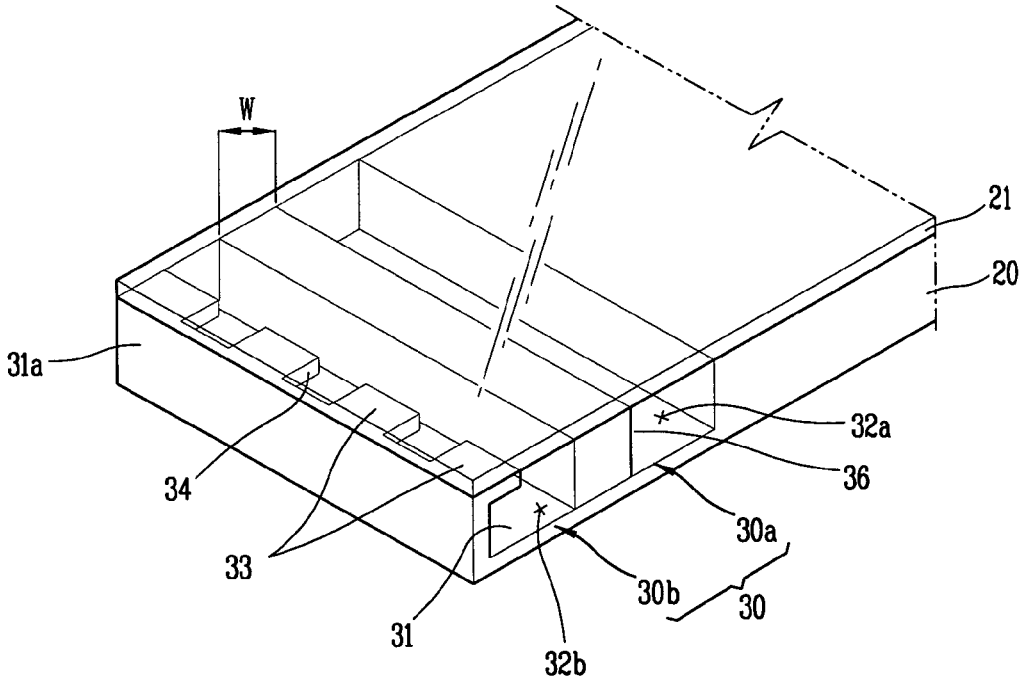
FIGS. 5 and 6 are perspective views showing a structure of the multi-stage choke seal in the microwave cooker according to the present invention.
Figure 6:
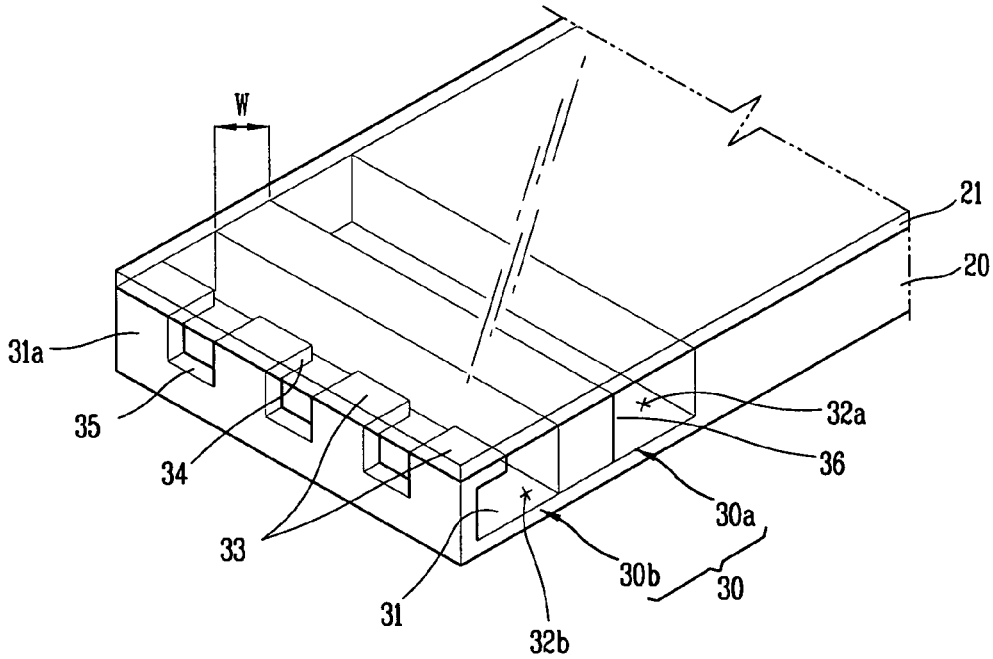
Figure 7:
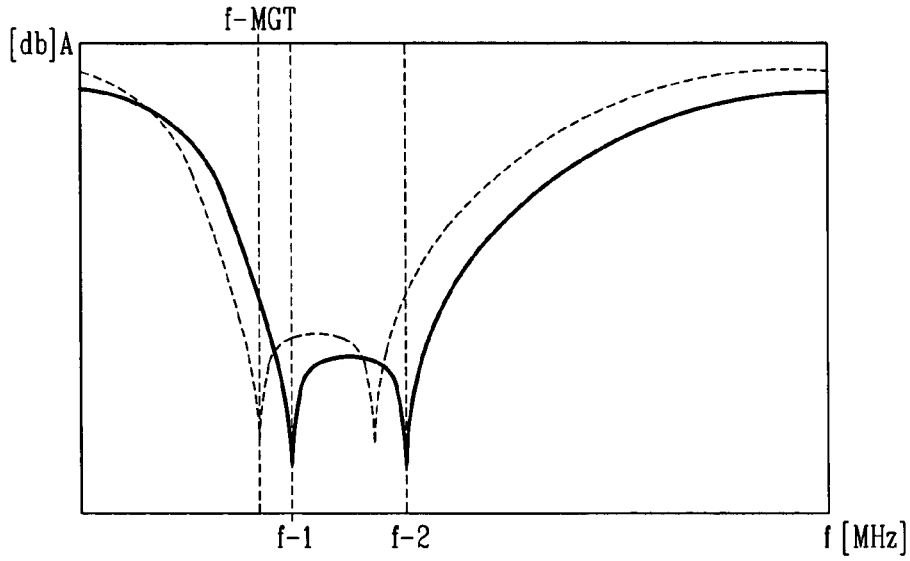
FIG. 7 is a graph showing a microwave damping curve by the multi-stage choke seal in the microwave cooker according to the present invention.
Figure 8:
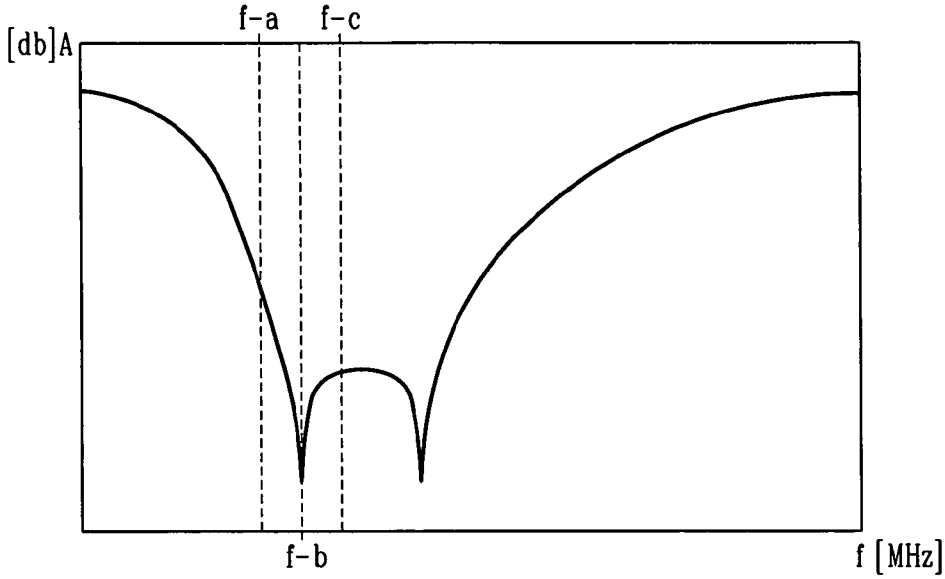
FIGS. 8 and 9 are views for explaining a principle of the multi-stage choke seal applied to FIGS. 2 to 7.
Figure 9:
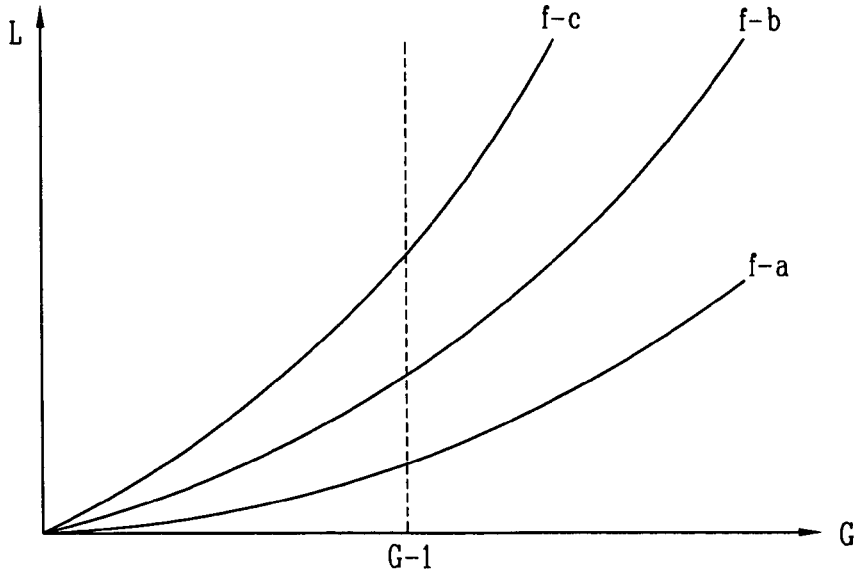

FIG. 2 is a perspective view showing a structure of a microwave cooker according to the present invention, FIG. 3 is a sectional view taken along line I-I of FIG. 2, FIG. 4 is an LC resonant circuit diagram applied to a multi-stage choke seal in the microwave cooker according to the present invention, FIGS. 5 and 6 are perspective views showing a structure of the multi-stage choke seal in the microwave cooker according to the present invention, FIG. 7 is a graph showing a microwave damping curve by the multi-stage choke seal in the microwave cooker according to the present invention, FIGS. 8 and 9 are views for explaining a principle of the multi-stage choke seal applied to FIGS. 2 to 7, and FIG. 10 is a view for comparing a microwave damping curve by the multi-stage choke seal of the microwave cooker according to the present invention with a conventional microwave damping curve.

As shown in FIGS. 2 to 10, the microwave cooker according to the present invention comprises a body 10 forming an appearance and having a cooking chamber 11 therein, the cooking chamber having one opened side for cooking food, a microwave source 12 disposed at the body 10 for supplying microwave to the cooking chamber 11, a door 20 rotatably coupled to a front surface of the body 10 for opening and closing the cooking chamber 11, and a multi-stage choke seal 30 formed at the door 20, having different resonant frequencies (f-1, f-2) at a frequency region higher than a central frequency of microwave, and having different LC resonant circuits for preventing the microwave from being leaked between the body 10 and the door 20.

The multi-stage choke seal comprises a first choke seal and a second choke seal cascaded to be in parallel with each other and spaced from each other with a certain gap (W).

A microwave supplying unit 13 for supplying microwave generated from the microwave source 12 to the cooking chamber 11 is provided at the body 10. Also, an adjustment unit 14 for controlling each kind of component and selecting a cooking mode is disposed at the right side of a front surface of the body 10.

The multi-stage choke seal 30 comprises a first choke seal 30*a* and a second choke seal 30*b* cascaded to be in parallel with each other and spaced from each other with a certain gap (W). The first choke seal 30*a* and the second choke seal 30*b* are composed of different LC resonant circuits.

That is, one of the first choke seal 30*a* and the second choke seal 30*b* is a short type choke seal provided with an LC resonant circuit comprising an inductance (L) and a capacitance (C) connected to the inductance at a resonant portion in series. Another of the first choke seal 30*a* and the second choke seal 30*b* is an open type choke seal provided with an LC resonant circuit comprising an inductance (L) and a capacitance (C) connected to the inductance at a resonant portion in parallel.

Hereinafter, will be explained a structure in which the first choke seal 30*a* is disposed at an inner side along a plate surface direction of the door 20, the second choke seal 30*b* is disposed at an outer side along the plate surface direction of the door 20, the first choke seal 30*a* is an open type choke seal, and the second choke seal 30*b* is a short type choke seal.

The multi-stage choke seal 30 comprises a groove 31 formed at a circumferential portion of the door 20 and having a first cavity 32*a* and a second cavity 32*b* spaced from each other with a certain gap (W) by a partition wall 36 formed in a longitudinal direction, each cavity having an opening towards a front surface of the body 10, a control plate 33 extending from a side wall 31*a* of the groove 31 for partially covering the opening of the second cavity 32*b* of the second choke seal 30*b*, and slots 34 formed along a progressive direction of the microwave and formed at the control plate 33 with a certain period in a circumferential direction of the door 20.

The partition wall 36 is fixed to a lower surface of the groove 31 in parallel with the side wall 31*a* of the groove 31 by a welding or a screw joint. The first cavity 32*a* of the first choke seal 30*a* has an electric length corresponding to ¼ of a wavelength when the cooking chamber 11 is closed by the door 20. The resonant frequency (f-1) of the first choke seal 30*a* can be varied by controlling a structure, a size, etc. of the first cavity 32*a* so that the inductance L and the capacitance C can be varied.

The resonant frequency (f-2) of the second choke seal 30*b* can be varied by controlling a structure, a size, etc. of each portion corresponding to the inductance L and the capacitance C.

In the microwave cooker according to a first embodiment of the present invention, the gap W between the first choke seal 30*a* and the second choke seal 30*b*, that is, between the first cavity 32*a* and the second cavity 32*b* having different LC resonant circuits are formed to have a length corresponding to 1/15 to 1/8 of a wavelength (A) of microwave.

That is, when the first choke seal 30*a* of an opened type having a maximum electric field and the second choke seal 30*b* of a short type having a maximum magnetic field are closed to each other, an interference is generated therebetween and thus the first and second choke seals are unstably operated. Therefore, the first choke seal 30*a* and the second choke seal 30*b* have to be spaced from each other with a gap corresponding to 1/15 to 1/8 of a wavelength (λ) of microwave.

When the cooking chamber 11 is closed by the door 20, the central frequency (f-MGT) of microwave is 2450 MHz and a difference between each resonant frequency (f-1, f-2) of the multi-stage choke seal 30 is within 400 MHz.

When the difference between each resonant frequency (f-1, f-2) of the multi-stage choke seal 30 is more than 400 MHz, a microwave damping function in each resonant frequency (f-1, f-2) region is lowered even if a wide bandwidth can be obtained. Therefore, the difference between each resonant frequency (f-1, f-2) of the multi-stage choke seal 30 has to be within 400 MHz. More preferably, the difference between each resonant frequency (f-1, f-2) of the multi-stage choke seal 30 is within 200 MHz.

A difference between the resonant frequency (f-1) of the multi-stage choke seal 30 adjacent to the central frequency (f-MGT) of microwave and the central frequency (f-MGT) of the microwave is within 250 MHz.

That is, when the door is initially opened (that is, when the door 20 is opened for a certain period before the microwave source 12 is completely turned off, and when a gap between the body 10 and the door 20 is generated), a resonant frequency of the choke seal used in the microwave cooker is moved within approximately 200 MHz. If the difference between the resonant frequency (f-1) of the multi-stage choke seal 30 adjacent to the central frequency (f-MGT) of microwave and the central frequency (f-MGT) of the microwave is more than 250 MHz, an optimum damping function provided form the multi-stage choke seal 30 is not implemented when the door 20 is initially opened. Therefore, the difference between the resonant frequency (f-1) of the multi-stage choke seal 30 adjacent to the central frequency (f-MGT) of microwave and the central frequency (f-MGT) of the microwave has to be within 250 MHz.

A leakage amount (L) of microwave is increased in proportion to a cube of a gap G between the body 10 and the door 20 when the gap is less than a wavelength (A) of microwave. Therefore, when the cooking chamber 11 is closed by the door 20, the leakage amount (L) from the gap G becomes different according to a tuned position of each resonant frequency (f-1, f-2) of the multi-stage choke seal 30.

When the cooking chamber 11 is closed by the door 20, the leakage amount (L) from the gap G between the body 10 and the door 20 becomes different according to a tuned position of the resonant frequency (f-1) adjacent to the central frequency (f-MGT) of microwave of each resonant frequency (f-1, f-2) of the multi-stage choke seal 30 among f-a, f-b, and f-c Therefore, as shown in FIGS. 8 and 9, the resonant frequency (f-1) of the first choke seal 30*a* is tuned to be positioned at the f-a region, thereby effectively blocking a microwave leakage from a gap (G-1) by which the microwave source 12 is turned off when the door 20 is opened.

One of the resonant frequencies f-1 and f-2 of the multi-stage choke seal 30 is constructed to be approximately equal to the central frequency (f-MGT) of microwave in order to implement an optimum damping function provided from the multi-stage choke seal 30 when the door 20 is initially opened.

Figure 10:
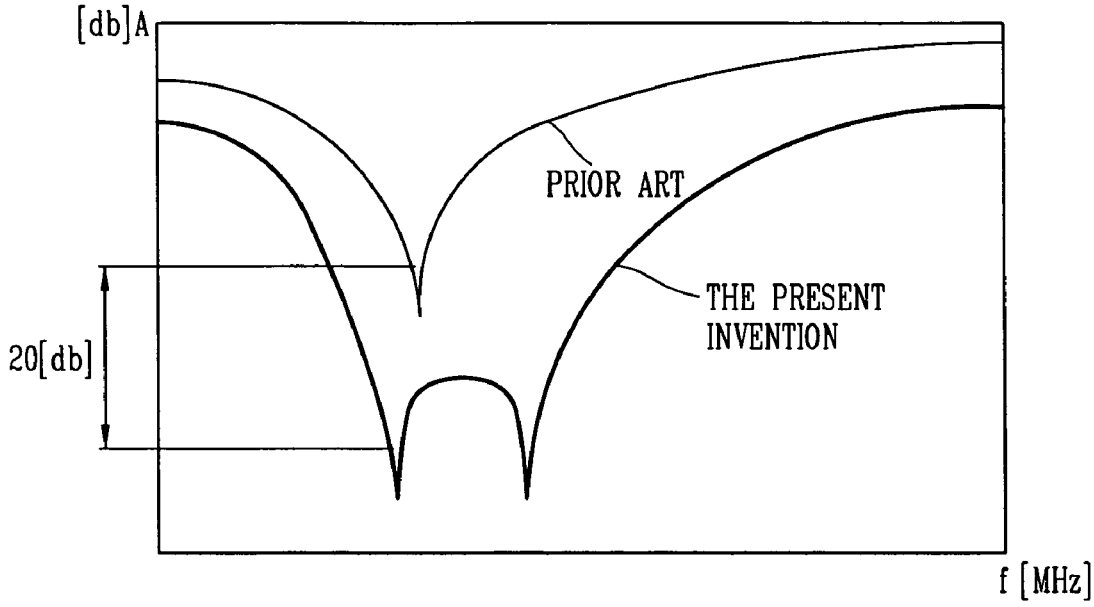
FIG. 10 is a view for comparing a microwave damping curve by the multi-stage choke seal of the microwave cooker according to the present invention with a conventional microwave damping curve.

In the microwave cooker according to a first embodiment of the present invention, the choke seals 30*a* and 30*b* of the multi-stage choke seal 30 having different resonant frequencies f-1 and f-2 are composed of different LC resonant circuits. In order to prevent the choke seals 30*a* and 30*b* from being interfered with each other due to the different LC resonant circuits, the choke seals 30*a* and 30*b* are spaced from each other with a certain gap W and the resonant frequencies f-1 and f-2 are adjacently disposed each other. Accordingly, as shown in FIG. 10, a damping function is increased by at least 20 dB when compared with the conventional damping function, and a microwave leakage blocking function is enhanced according to a variation of the gap between the body 10 and the door 20 is enhanced.

The choke seals 30*a* and 30*b* of the multi-stage choke seal 30 composed of different LC resonant circuits of different electric/magnetic characteristics are prevented from being interfered with each other, and the resonant frequencies f-1 and f-2 are disposed to be adjacent to each other.

Furthermore, in the present invention, each resonant frequency f-1 and f-2 of the multi-stage choke seal 30 is disposed at a frequency region higher than the central frequency (f-MGT) of microwave, and one of the resonant frequencies (f-1 and f-2) has the same frequency as the central frequency (f-MGT) of microwave when the door 20 is initially opened. Therefore, even if a gap between the body 10 and the door 20 is generated before the microwave source 12 is completely turned off when the door 20 is initially opened, an optimum damping function provided from the multi-stage choke seal 30 can be implemented. Also, even if a large gap more than approximately 4 mm is generated between the body 10 and the door 20, a microwave leakage blocking is effectively performed.

As shown in FIG. 6, the second choke seal 30*b* of the multi-stage choke seal 30 further comprises a slit 35 connected to the slot 34 and having a certain depth at the side wall 31*a* of the groove 31. A microwave damping function can be stably implemented according to a variation of an incident angle of electromagnetic wave by the slit 35.

A transparent window 21 for viewing inside of the cooking chamber 11 is formed of glass, plastic, etc., and is coupled to the door 20. The transparent window 21 has a size corresponding to a size of a front surface of the body 10, and is coupled to the door 20 so as to be disposed between the door 20 and the body 10.

An inner surface of the door 20 is entirely covered by the transparent window, so that an additional choke cover (not shown) for covering the multi-stage choke seal 30 is not required and the inner surface of the door 20 has an improved design. Furthermore, the inner surface of the door 20, especially, the choke seal 30 that is not easily cleaned is prevented from being contaminated by odor, smoke, etc. generated from food inside the cooking chamber 11, and the door 20 can be easily cleaned.

Preferably, the control plate 33 is formed along a plate surface direction of the door 20 so as to come in contact with the transparent window 21.

In the preferred embodiment of the present invention, the first choke seal 30*a* is disposed at an inner side along a plate surface direction of the door 20, the second choke seal 30*b* is disposed at an outer side along the plate surface direction of the door 20, the first choke seal 30*a* is an open type choke seal, and the second choke seal 30*b* is a short type choke seal. However, it is also possible to construct that the first choke seal 30*a* disposed at an inner side along a plate surface direction of the door 20 is a short type choke seal, and the second choke seal 30*b* disposed at an outer side along the plate surface direction of the door 20 is an open type choke seal.

As aforementioned, in the microwave cooker of the present invention, a microwave leakage blocking function is enhanced.

Especially, a microwave leakage blocking function can be stably implemented in correspondence to a variation of the gap between the body and the door. Even if a gap more than a certain degree is generated between the body and the door, an optimum microwave damping function is implemented and thus a microwave leakage is effectively prevented.

Furthermore, the inner surface of the door has an improved design and can be easily cleaned.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A microwave oven, comprising:

a body having a cooking chamber therein, the cooking chamber having one opened side;

a microwave source disposed at the body for supplying a microwave to the cooking chamber;

a door coupled to the body for opening and closing the cooking chamber; and a multi-stage choke seal formed at the door, having different resonant frequencies at a frequency region higher than a central frequency of the microwave, and having different LC resonant circuits for preventing the microwave from being leaked between the body and the door, wherein the multi-stage choke seal comprises a first choke seal and a second choke seal spaced from each other with a certain gap and cascaded to be in parallel with each other, and wherein the gap between the choke seals is 1/15 to 1/8 of a wavelength of the microwave.

2. The microwave oven of claim 1, wherein one choke seal of the multi-stage choke seal is provided with an LC resonant circuit having an inductance and a capacitance connected to the inductance in series, and another choke seal of the multi-stage choke seal is provided with an LC resonant circuit having an inductance and a capacitance connected to the inductance in parallel.

3. The microwave oven of claim 2, wherein the multi-stage choke seal comprises:

a groove formed at a circumferential portion of the door and having a first cavity and a second cavity spaced from each other with a certain gap by a partition wall each having an opening towards a front surface of the body;

a control plate extending from one of the partition wall and a side wall of the groove for partially covering one of the two openings; and slots formed at the control plate with a certain period in a circumferential direction of the door.

4. The microwave oven of claim 3, wherein the slot is extending from the side wall of the groove, and a slit connected to the slot is formed at the side wall of the groove.

5. The microwave oven of claim 1, wherein a difference between each resonant frequency of the multi-stage choke seal is within 400 MHz.

6. The microwave oven of claim 5, wherein a difference between a resonant frequency of the multi-stage choke seal adjacent to a central frequency of the microwave and the central frequency of the microwave is within 250 MHz.

7. The microwave oven of claim 6, wherein when the door is initially opened, one of each resonant frequency of the multi-stage choke seal is approximately the central frequency of the microwave.

8. The microwave oven of claim 7, wherein a transparent window having a size corresponding to a size of a front surface of the body for viewing inside of the cooking chamber is coupled to the door so as to be disposed between the door and the body.

9. The microwave oven of claim 8, wherein the control plate is formed along a plate surface direction of the door so as to come in contact with the transparent window.

10. A microwave oven, comprising:

a body having a cooking chamber therein, the cooking chamber having one opened side;

a microwave source disposed at the body for supplying a microwave to the cooking chamber;

a door coupled to the body for opening and closing the cooking chamber; and a multi-stage choke seal formed at the door for preventing the microwave from being leaked between the body and the door, the multi-stage choke seal including:

a groove formed at a circumferential portion of the door and having a first cavity and a second cavity spaced from each other with a certain gap by a partition wall each having an opening towards a front surface of the body;

a control plate extending from one of the partition wall and a side wall of the groove for partially covering one of the two openings; and slots formed at the control plate with a certain period in a circumferential direction of the door, wherein the gap between the first cavity and the second cavity is 1/15 to 1/8 of a wavelength of the microwave.

11. The microwave oven of claim 10, wherein the slot is extending from the side wall of the groove, and a slit connected to the slot is formed at the side wall of the groove.

12. The microwave oven of claim 11, wherein a transparent window having a size corresponding to a size of a front surface of the body for viewing inside of the cooking chamber is coupled to the door so as to be disposed between the door and the body.

13. The microwave oven of claim 12, wherein the control plate is formed along a plate surface direction of the door so as to come in contact with the transparent window.

14. The microwave oven of claim 10, wherein the multi-stage choke seal has different resonant frequencies at a frequency region higher than a central frequency of the microwave when the cooking chamber is closed by the door.

15. The microwave oven of claim 14, wherein a difference between each resonant frequency of the multi-stage choke seal is within 400 MHz.

16. The microwave oven of claim 15, wherein a difference between a resonant frequency of the multi-stage choke seal adjacent to a central frequency of the microwave and the central frequency of the microwave is within 250 MHz.

17. The microwave oven of claim 16, wherein when the door is initially opened, one of each resonant frequency of the multi-stage choke seal is approximately the central frequency of the microwave.

* * * * *